United States Patent [19]

Fujii et al.

[11] Patent Number: 4,596,600

[45] Date of Patent: Jun. 24, 1986

[54] STEEL-MAKING PROCESS IN CONVERTER

[75] Inventors: Tetsuya Fujii; Toshikazu Sakuraya; Hideo Nakamura; Yasuhiro Habu, all of Chiba; Takuo Imai, Kurashiki, all of Japan

[73] Assignee: Kawasaki Steel Corporation, Kobe, Japan

[21] Appl. No.: 771,212

[22] Filed: Aug. 30, 1985

[51] Int. Cl.[4] ..... C21C 5/34; C21C 7/10

[52] U.S. Cl. ..... 75/59.2; 75/49; 75/59.21; 75/59.22

[58] Field of Search ..... 75/49, 59.2, 59.21, 75/59.22

[56] References Cited

U.S. PATENT DOCUMENTS

| | | | |
|---|---|---|---|
| 3,854,932 | 12/1974 | Bishop | 75/49 |
| 4,389,246 | 6/1983 | Okamura | 75/59.2 |
| 4,456,477 | 6/1984 | Masuda | 75/59.2 |

FOREIGN PATENT DOCUMENTS

| | | |
|---|---|---|
| 84747/82 | 6/1982 | Australia . |
| 14928/83 | 5/1983 | Australia . |
| 65302/80 | 6/1984 | Australia . |
| EP0099713 | 2/1984 | European Pat. Off. . |

*Primary Examiner*—Peter D. Rosenberg

*Attorney, Agent, or Firm*—Balogh, Osann, Kramer, Dvorak, Genova & Traub

[57] ABSTRACT

A steel-making process in a converter, which includes using a carbon monoxide gas as an agitating gas supplied from a position lower than molten metal bath level.

2 Claims, 1 Drawing Figure

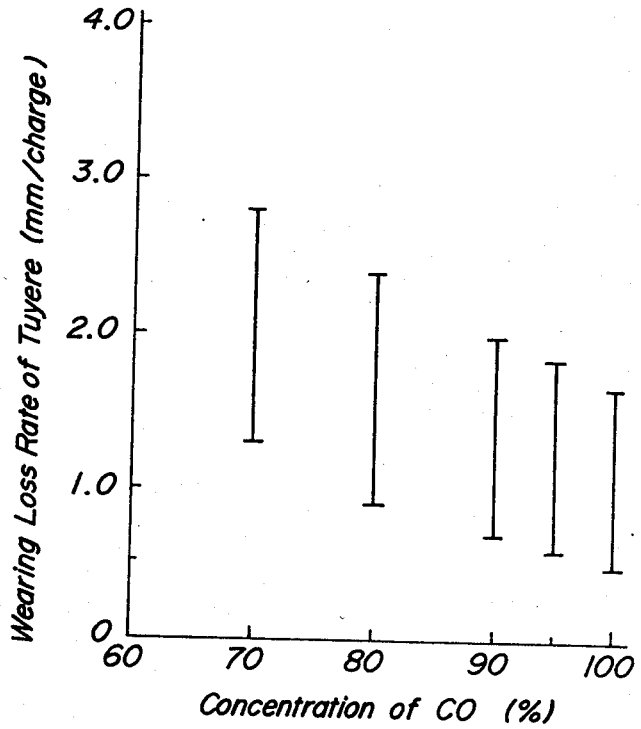
4.0
3.0
2.0
1.0
0
Wearing Loss Rate of Tuyere (mm/charge)
60
70
80
90
100
Concentration of CO (%)

STEEL-MAKING PROCESS IN CONVERTER

BACKGROUND OF THE INVENTION

1. Field of the Invention

This invention relates to a steel-making process in a converter, and more particularly to a steel-making process wherein carbon monoxide, which is cheap and effective for improving the service life of tuyere without damaging the quality of molten steel, is used as a blowing gas for effectively agitating molten steel in a refining vessel to advantageously promote the refining reaction.

2. Related Art Statement

In general, an oxygen top-blown converter (LD process) has been used for obtaining molten steel be decarburizing hot metal and simultaneously reducing impurity elements such as P, S and the like in hot metal.

In this type of the converter, a bottom blowing process with an inert gas has been recently popularized for the enhancement of refining properties.

It is known that the bottom blowing of the inert gas is largely effective for strengthening the agitation of molten steel bath in the converter as well as for the reduction of impurities, increase of iron yield, increase of control accuracy between component and temperature at blowing end and the like.

Heretofore, argon (Ar), nitrogen ($N_2$) or carbon dioxide ($CO_2$) has been used as an agitating gas.

Ar gas is completely inert to molten steel, so that it is adaptable for the above mentioned object but is expensive.

On the other hand, $N_2$ gas is cheaper than Ar gas but dissolves into molten steel, so that the nitrogen concentration in molten steel is increased during the blowing in the converter, which may raise problems in the quality of steel.

$CO_2$ gas is able to reduce an amount of top-blown $O_2$ gas by a part corresponding to a decarburization reaction of $CO_2+C \rightarrow 2CO$ produced when the carbon concentration in molten steel is high, and is relatively low in the cost, so that the use of $CO_2$ gas is economically advantageous. However, $CO_2$ gas is an oxidizing gas different from Ar and $N_2$ gases, so that the service life of a tuyere for blowing the gas into molten steel or a porous plug becomes shorter.

Besides the above gases, it has bee proposed to use an unburned exhaust gas recovered from the converter or a so-called LD gas as a cheap agitating gas. However, such an LD gas contains a fairly great amount of $N_2$ gas and $CO_2$ gas, which comes into problems in view of the service life of tuyere and the increase of nitrogen concentration in molten steel as mentioned above, so that the use of LD gas is not yet practised.

SUMMARY OF THE INVENTION

It is an object of the invention to eliminate the aforementioned problems accompanied with the conventional agitating gases and to provide a steel-making process in a converter, in which carbon monoxide is used as an agitating gas to reduce wearing loss of tuyere for gas blowing and porous bricks without causing problems on the cost and the quality of molten steel.

According to the invention, there is the provision of a process for making steel in a converter by supplying an oxygen gas from a position higher than molten steel bath level and a gas from a position lower than the bath level, respectively, which comprises using a carbon monoxide gas as an agitating gas to be supplied from the position lower than the bath level.

In a preferred embodiment of the invention, the agitating gas contains not less than 80% by volume of carbon monoxide gas.

BRIEF DESCRIPTION OF THE DRAWING

A single FIGURE is a graph showing an influence of CO concentration on wearing loss rate of tuyere.

DETAILED DESCRIPTION OF THE INVENTION

The inventors have made studies with respect to the agitating gas used in the steel-making process and found that the durability of gas inlet ports such as tuyere, porous plug and the like can be considerably enhanced without causing problems affecting the quality of molten steel by using cheap carbon monoxide gas as the agitating gas.

In this connection, the invention will be described in detail with reference to the following experiment.

At first, a tuyere made of a stainless steel tube with an inner diameter of 3 mm and having a structure capable of blowing an inert gas such as CO gas or others was arranged in a bottom of a converter of 5 t capacity made from magnesia carbon bricks, and about 5 tons of hot metal (e.g. C=4.2%, Si=0.28%, Mn=0.36%) of 1,200°-1,240° C. was charged into the converter. Then, $O_2$ gas was supplied at a rate of 15 $Nm^3$/min from a top-blowing lance, while an agitating gas was supplied from the bottom through the tuyere.

After the blowing was repeated until molten steel was decarburized to C=0.03-0.07%, the wearing loss rate of the tuyere accompanied with the blowing was measured for examining the worn state of the tuyere and the bottom bricks surrounding it.

In this case, the temperature of molten steel was set to 1,630°-1,670° C. at the blowing end.

As the agitating gas, each of Ar gas, $N_2$ gas, $CO_2$ gas and CO gas was used at a rate of 0.05-0.25 $Nm^3$/min per ton of hot metal. The experiment using each agitating gas was carried out at 10 charges, and thereafter the average wearing loss rate was measured.

As a result, the wearing loss rate was 1.1-2.5 mm/charge in case of using Ar gas and $N_2$ gas, 1.9-3.8 mm/charge in case of using $CO_2$ gas, and 0.4-1.6 mm/charge in case of using CO gas, respectively, from which it is obvious that the use of CO gas is effective for preventing the wearing loss of the tuyere.

Moreover, high-purity CO gas is usually produced by thermal decomposition of formic acid, while low-purity CO gas is produced by partial oxidation of asphalt or pitch, or the like. However, the former is undesirably expensive, while the latter has a close relation between the purity and the cost.

Now, the inventors have made studies with respect to the acceptable limit on concentrations of $H_2$ gas, $CO_2$ gas and $N_2$ gas contained as a main impurity in CO gas.

As a result of experiments using CO gas with a purity of 90-100% obtained by adding $H_2$ gas in an amount of up to 10% to CO gas, it is apparent that such an addition of $H_2$ gas hardly affects the service life of the tuyere. However, when the concentration of $H_2$ gas in CO gas exceeds 10%, the wearing loss rate of the tuyere increases and the increase of H concentration in molten steel is observed at the blowing end, so that the addition of more than 10% of $H_2$ gas becomes disadvantageous to the quality of molten steel.

As to the concentration of $CO_2$ gas, the experiment was made in the same manner as described above using CO gas with a purity of 70–100% obtained by adding $CO_2$ gas to CO gas. WHen the concentration of CO is not less than 80%, as shown in the single figure, it is obvious that the wearing loss rate of the tuyere is less than a range of 0.9–2.4 mm/charge, which has an effect for the protection of tuyere equal to or larger than the case of using Ar or $N_2$ gas (wearing loss rate: 1.1–2.5 mm/charge), and particularly the effect is more improved at the CO concentration of not less than 90%.

Further, the influence of $N_2$ concentration on the service life of the tuyere was examined in the same manner as previously mentioned using CO gas with a purity of 50–100% obtained by adding $N_2$ gas to CO gas. As a result, there has been observed a tendency of increasing the wearing loss of the tuyere as the CO concentration decreases, but the wearing loss was small as compared with the case of using 100% $N_2$ gas. Further, the increase of N concentration in molten steel was observed at the blowing end together with the increase of $N_2$ concentration in CO gas, which causes a problem affecting the quality of steel products.

In this connection, it has been confirmed that when the blowing amount of the agitating gas per ton of hot metal is within a range of 0.05–0.25 $Nm^3$/min, it is necessary to limit the $N_2$ concentration in CO gas to not more than 15% in order to restrict the N concentration in molten steel at the blowing end to not more than 20 ppm which causes no problem in the product quality.

As described above, it is obvious that the gas consisting mainly of CO is excellent in the effect of preventing the wearing loss of the tuyere as an agitating gas for a converter. This is considered to be due to the face that CO gas acts to prevent the oxidation of bricks surrounding the tuyere by FeO since CO gas is not merely an inert gas but a reducing gas as is well-known. Also, it is considered that a part of CO gas blown dissolves into molten steel as C and O according to a reaction of CO (g)→C+O produced in the vicinity of the tuyere, during which the tuyere is cooled by the above endothermic reaction.

Although the invention has been mainly explained with respect to the steel-making process in the converter, it is needless to say that when the invention is applied to various ladle-refining processes as a gas blown into molten steel for the acceleration of reaction, the damage of gas blowing tuyere or porous plug can effectively be avoided.

According to the invention, the durability of gas blowing means can considerably be enhanced by agitating molten metal with CO gas of a purity obtained relatively cheaply without adversely affecting the product quality.

What is claimed is:

1. A process for making steel in a converter by supplying an oxygen gas from a position higher than molten steel bath level and an agitating gas from a position lower than the bath level, respectively, which process comprises using as said agitating gas, a gas containing not less than 80% by volume of carbon monoxide gas.

2. The process according to claim 1, wherein said agitating gas is supplied in a blowing amount of 0.05–0.25 $Nm^3$/min per ton of hot metal.

* * * * *